US011153689B2

(12) United States Patent
Miyamoto et al.

(10) Patent No.: US 11,153,689 B2
(45) Date of Patent: Oct. 19, 2021

(54) LOUDSPEAKER AND METHOD OF MANUFACTURING LOUDSPEAKER

(71) Applicant: PANASONIC INTELLECTUAL PROPERTY MANAGEMENT CO., LTD., Osaka (JP)

(72) Inventors: Takuji Miyamoto, Okayama (JP); Kengo Takeda, Osaka (JP); Kazuma Fujioka, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/841,253

(22) Filed: Apr. 6, 2020

(65) Prior Publication Data

US 2020/0245072 A1 Jul. 30, 2020

Related U.S. Application Data

(63) Continuation of application No. PCT/JP2018/037521, filed on Oct. 9, 2018.

(30) Foreign Application Priority Data

Oct. 12, 2017 (JP) ..... JP2017-198553

(51) Int. Cl.
*H04R 9/02* (2006.01)
*H04R 31/00* (2006.01)
*H04R 7/26* (2006.01)

(52) U.S. Cl.
CPC ..... *H04R 9/025* (2013.01); *H04R 7/26* (2013.01); *H04R 31/00* (2013.01)

(58) Field of Classification Search
CPC ..... H04R 9/025; H04R 7/26; H04R 31/00; H04R 1/06; H04R 2499/13; H04R 9/04; H04R 7/22
See application file for complete search history.

(56) References Cited

U.S. PATENT DOCUMENTS 5,583,944 A * 12/1996 Morohoshi ..... H04R 1/06 381/400
8,155,374 B2 * 4/2012 Yuasa ..... H04R 1/06 381/412

(Continued)

FOREIGN PATENT DOCUMENTS

JP 04-326299 11/1992
JP 06-253381 9/1994

(Continued)

OTHER PUBLICATIONS

International Search Report issued in International Pat. Appl. No. PCT/JP2018/037521, dated Dec. 25, 2018, along with English translation.

(Continued)

*Primary Examiner* — Brian Ensey
(74) *Attorney, Agent, or Firm* — Greenblum & Bernstein, P.L.C.

(57) ABSTRACT

A loudspeaker including a magnetic circuit; a voice coil body; a diaphragm attached to the voice coil body; a housing which accommodates the magnetic circuit and the voice coil body and to which an outer circumferential portion of the diaphragm and the magnetic circuit are attached; two connection terminals disposed exposed inside and outside the housing; and signal wires which extend from the voice coil body and are connected to the connection terminals. Each signal wire is outwardly curved to be away from a virtual straight line connecting the proximal end of the signal wire and the connection portion. The distal end of the signal wire projects from the connection portion toward the voice coil body.

4 Claims, 7 Drawing Sheets

(56) References Cited

U.S. PATENT DOCUMENTS

| | | | | |
|---|---|---|---|---|
| 8,638,976 | B2 * | 1/2014 | Watanabe | H04R 1/00 381/400 |
| 2016/0142803 | A1 | 5/2016 | Ara et al. | |

FOREIGN PATENT DOCUMENTS

| | | | |
|---|---|---|---|
| JP | 06-327079 | | 11/1994 |
| JP | 10-098789 | | 4/1998 |
| JP | 2001-285979 | | 10/2001 |
| JP | 2006-340015 | | 12/2006 |
| WO | 2009/063567 | A1 | 5/2009 |
| WO | 2014/156017 | | 10/2014 |

OTHER PUBLICATIONS

Notice of Reasons for Refusal (including English Language Translation), dated Jun. 29, 2021, for Japanese Patent Application No. 2017-198553.

* cited by examiner

LOUDSPEAKER AND METHOD OF MANUFACTURING LOUDSPEAKER

CROSS REFERENCE TO RELATED APPLICATIONS

This is a U.S. continuation application of PCT International Application Number PCT/JP2018/037521 filed on Oct. 9, 2018, designating the United States of America, which is based on and claims priority of Japanese Patent Application Number 2017-198553 filed on Oct. 12, 2017.

BACKGROUND

1. Technical Field

The present disclosure relates to a loudspeaker and a method of manufacturing a loudspeaker.

2. Description of the Related Art

As one type of loudspeakers, Japanese Unexamined Patent Application Publication No. H10-98789 (Patent Literature (PTL) 1) discloses a sealed type loudspeaker including a box-shaped frame which holds a diaphragm, the frame also serving as an enclosure which accommodates a magnetic circuit and the like.

In such a loudspeaker, in some cases, a connection terminal may be disposed to penetrate through the enclosure as described in Japanese Unexamined Patent Application Publication No. H6-327079 (PTL 2), for example, in order to transmit acoustic signals to a voice coil.

SUMMARY

However, the loudspeakers according to PTL 1 and PTL 2 can be improved upon.

In view of this, the present disclosure provides a speaker and a method of manufacturing a loudspeaker which are capable of improving upon the above related art.

A loudspeakers according to an aspect of the present disclosure includes a magnetic circuit including a magnetic gap; a voice coil body disposed in the magnetic gap in an inserted state; a diaphragm having an inner circumferential portion attached to the voice coil body; a housing which accommodates the magnetic circuit and the voice coil body and to which an outer circumferential portion of the diaphragm and the magnetic circuit are attached; two connection terminals disposed in a state where one ends of the two connection terminals are exposed inside the housing and another ends of the two connection terminals are exposed outside the housing; and two signal wires each extending from the voice coil body and having a distal end connected to a corresponding one of the two connection terminals. Each of the two signal wires is outwardly curved to be away from a virtual straight line connecting a proximal end of a corresponding one of the two signal wires, which is closer to the voice coil body, and a connection portion of the corresponding one of the two signal wires to the corresponding one of the two connection terminals, and the distal end of the corresponding one of the two signal wires projects from the connection portion toward the voice coil body.

A method of manufacturing a loudspeaker according to an aspect of the present disclosure includes a method of manufacturing a loudspeaker, comprising: accommodating a magnetic circuit and a voice coil body in a housing, the magnetic circuit including a magnetic gap and the voice coil body being disposed in the magnetic gap in an inserted state; inserting a wiring jig into a through hole disposed in a wall of the housing in a direction orthogonal to an axis line of the voice coil body in a region which extends between the voice coil body and two connection terminals and is closer to an opening of the housing than proximal ends of two signal wires; molding the two signal wires, which extend from the voice coil body, into a curve shape using the wiring jig so as to project toward the opening of the housing; connecting the two signal wires to the two connection terminals each having one end exposed inside the housing and another end exposed outside the housing; removing the wiring jig from the housing; and closing the through hole with a closing member.

A loudspeaker and a method of manufacturing a loudspeaker according to one aspect of the present disclosure are capable of improving upon the above related art.

BRIEF DESCRIPTION OF DRAWINGS

These and other objects, advantages and features of the disclosure will become apparent from the following description thereof taken in conjunction with the accompanying drawings that illustrate a specific embodiment of the present disclosure.

DETAILED DESCRIPTION OF THE EMBODIMENTS

In the conventional loudspeakers, if the frame and the enclosure are integrally formed as a compact housing, such a compact housing results in difficulties in wiring of the signal wire, which extends from the voice coil to the connection terminal, inside the housing. It also results in difficulties during the operation to connect the signal wire to the connection terminal attached to the housing.

In view of this, a loudspeaker according to one aspect of the present disclosure includes a magnetic circuit including a magnetic gap; a voice coil body disposed in the magnetic gap in an inserted state; a diaphragm having an inner circumferential portion attached to the voice coil body; a housing which accommodates the magnetic circuit and the voice coil body and to which an outer circumferential portion of the diaphragm and the magnetic circuit are attached; two connection terminals disposed in a state where one ends of the two connection terminals are exposed inside the housing and another ends of the two connection terminals are exposed outside the housing; and two signal wires each extending from the voice coil body and having a distal end connected to a corresponding one of the two connection terminals. Each of the two signal wires is outwardly curved to be away from a virtual straight line connecting a proximal end of a corresponding one of the two signal wires, which is closer to the voice coil body, and a connection portion of the corresponding one of the two signal wires to the corresponding one of the two connection terminals, and the distal end of the corresponding one of the two signal wires projects from the connection portion toward the voice coil body.

Such a configuration results in a signal wire having an appropriate shape from the voice coil body to the connection terminal inside the housing. Accordingly, this configuration can also avoid undesirable influences on acoustic properties caused by interference of the signal wire from the diaphragm during driving of the loudspeaker.

Hereinafter, a loudspeaker according to one or more exemplary embodiments will be specifically described with reference to the drawings. The embodiments to be described below only show specific examples of the present disclosure. Numeral values, shapes, materials, components, arrangements, positions, and connection forms of the components, steps, order of the steps, and the like shown in the embodiments below are only examples, and will not limit the present disclosure. Moreover, among the components of the embodiments below, the components not described in an independent claim representing the most superordinate concept of the present disclosure will be described as arbitrary components.

The drawings are schematic views including appropriate emphasis or omission and adjustment of ratios in order to illustrate present disclosure, and may be different from actual shapes, positional relations, and ratios in some cases.

Embodiment 1

Figure 1:
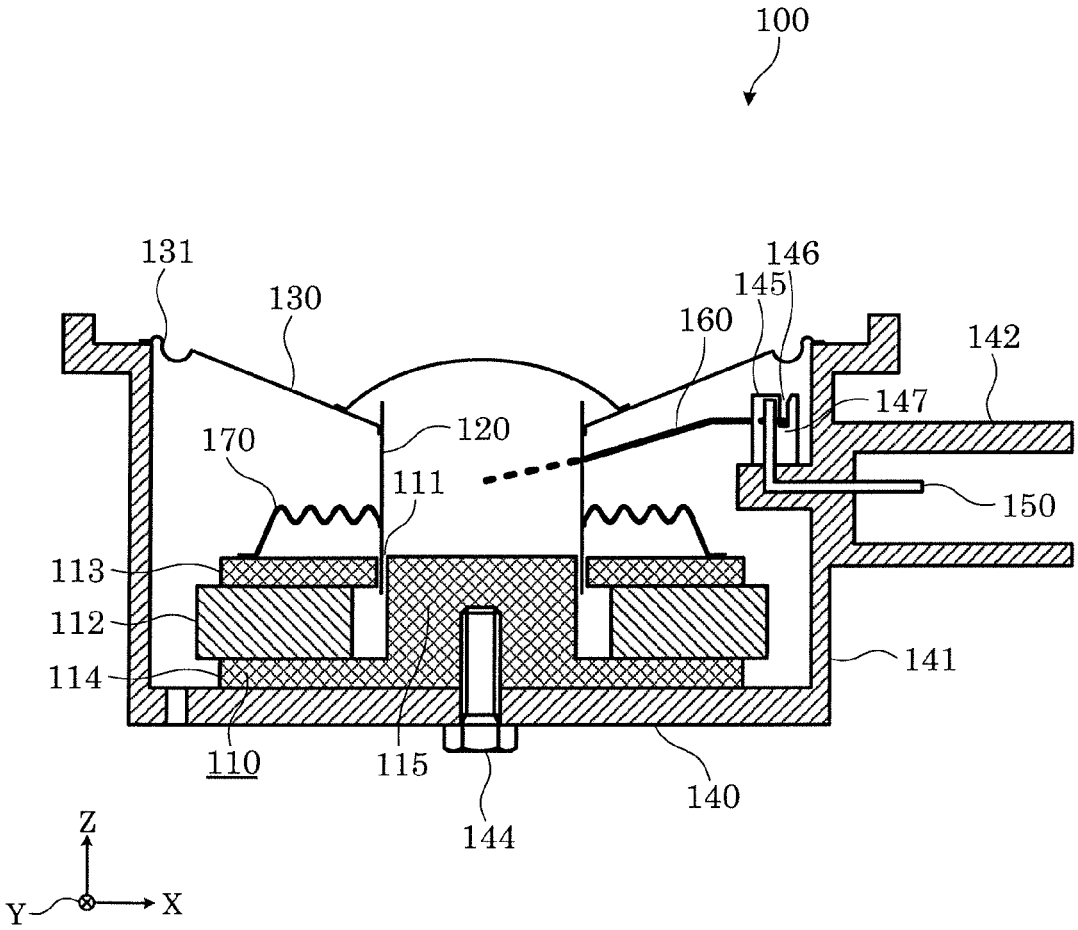
FIG. 1 is a sectional view illustrating the loudspeaker according to Embodiment 1.
Figure 2:
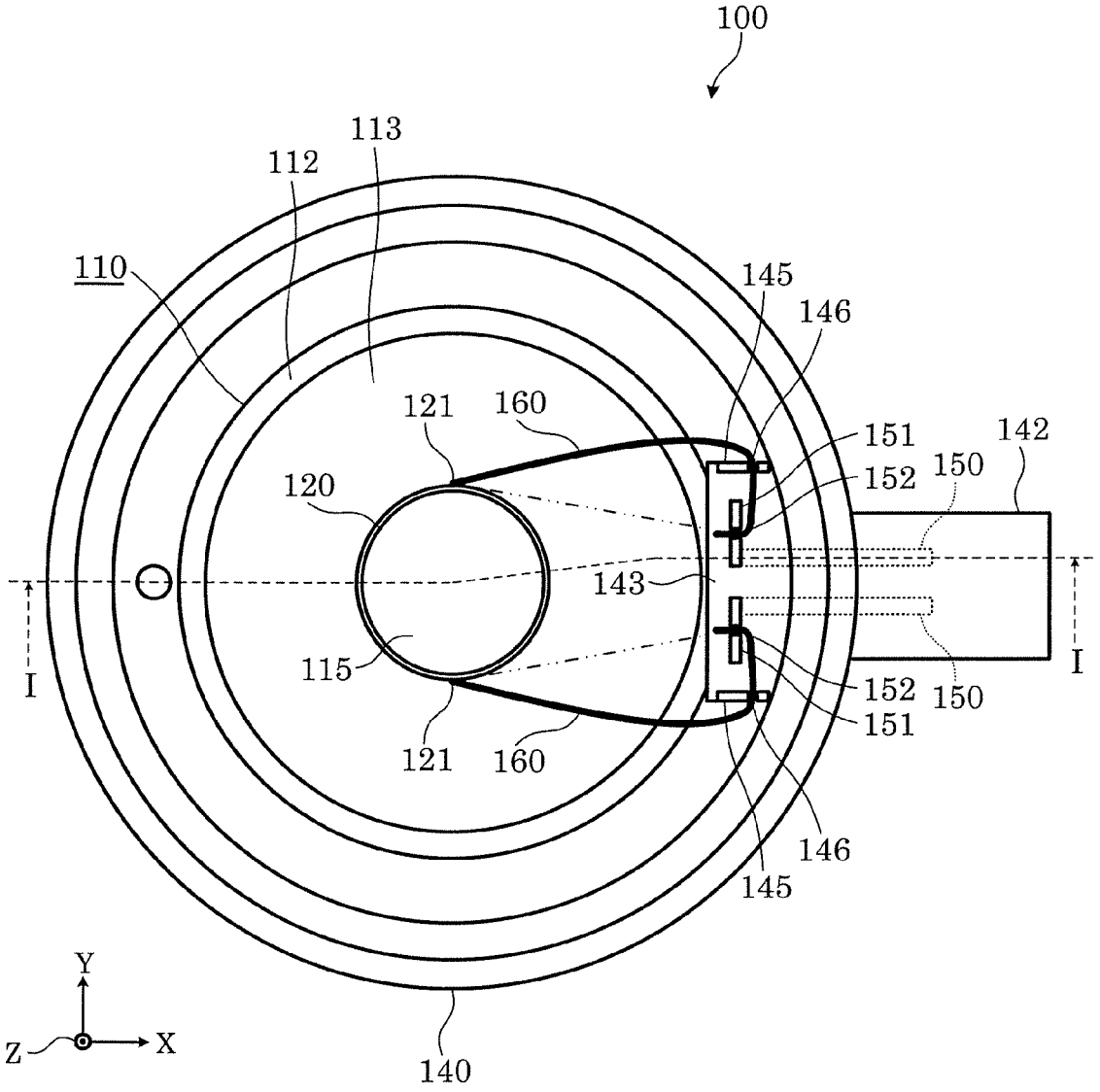
FIG. 2 is a plan view illustrating the loudspeaker according to Embodiment 1, where the diaphragm, the damper, and the like are omitted.

FIG. 1 is a sectional view illustrating the loudspeaker according to Embodiment 1. FIG. 2 is a plan view illustrating the loudspeaker according to Embodiment 1, where a diaphragm, a damper, and the like are omitted. FIG. 1 illustrates a cross-section taken along line I-I illustrated in FIG. 2.

As illustrated in these drawings, loudspeaker 100 includes magnetic circuit 110, voice coil body 120, diaphragm 130, housing 140, connection terminal 150, and signal wire 160.

In the case of the present embodiment, loudspeaker 100 is a loudspeaker mounted on moving bodies such as automobiles, and specifically is a compact loudspeaker which can be embedded in a limited space inside the moving body. In this specification, the term "compact" may be used to refer to a loudspeaker including housing 140 having an inner diameter of 10 cm or less.

Magnetic circuit 110 generates a steady state magnetic flux which acts on a magnetic flux which changes based on an electric signal input to voice coil body 120. Magnetic circuit 110 is attached to housing 140 to be located posterior to diaphragm 130. Magnetic circuit 110 includes magnetic gap 111 which has an annular shape and faces diaphragm 130. Magnetic gap 111 is a gap where the steady state magnetic flux is generated in a direction orthogonal to the magnetic flux generated in voice coil body 120.

In the case of the present embodiment, magnetic circuit 110 is of an external magnet type, and includes cylindrical magnet 112 which is magnetized, annular top plate 113 disposed on a surface of magnet 112 on the side of diaphragm 130, disk-like base plate 114 disposed on magnet 112 on the side opposite to top plate 113, and center pole 115 which is inserted from the central portion of base plate 114 into a through hole of top plate 113 to form magnetic gap 111 with top plate 113. Base plate 114 is integrally formed with center pole 115.

Top plate 113, base plate 114, and center pole 115 are made of a magnetic material. Magnet 112 can be a neodymium-based magnet having high magnetic energy, for example. Such a configuration can reduce the thickness of magnet 112 and thus the entire thickness of loudspeaker 100. Furthermore, the weight of the loudspeaker can also be reduced.

Magnet 112 is a permanent magnet having a circular plate shape and having a through hole formed in the center hereof. Center pole 115 is inserted into the through hole. Magnet 112 has the N pole at one end thereof and the S pole at the other end thereof in the thickness direction (in the Z-axis direction in the drawing). Top plate 113 is fixed onto the surface of magnet 112 having one of the S and N poles, and base plate 114 is fixed onto the surface thereof having the other pole. Top plate 113, magnet 112, and base plate 11 can be fixed by any method without limitation. In the case of the present embodiment, these components are fixed with an adhesive. The components may be fixed with a fastening member such as a screw or a rivet.

Loudspeaker 100 can include any type of magnetic circuit 110, and magnetic circuit 110 of an internal magnet type may also be used.

One end of voice coil body 120 is disposed inside magnetic gap 111 of magnetic circuit 110 and the other end thereof is attached to diaphragm 130. Voice coil body 120 generates a magnetic flux based on the electric signal to be input, and vibrates in the winding axis direction (in the Z-axis direction in the drawing) as a result of interaction with the magnetic flux generated by magnetic circuit 110.

The winding axis (central axis) of voice coil body 120 is disposed in the direction of the vibration (amplitude) of diaphragm 130 (in the Z-axis direction in the drawing), and is orthogonal to the direction of the magnetic flux inside magnetic gap 111.

In the case of the present embodiment, voice coil body 120 includes a coil prepared by winding a single metallic wire material several times into loops (into a cylindrical shape), and a bobbin around which the coil is wound. The bobbin is a tubular member made of a material such as aluminum or a resin. The front end of the bobbin is bonded to diaphragm 130 and the back end thereof is disposed inside magnetic gap 111. Bothe ends of the coil as signal wires 160 extend from voice coil body 120. Signal line 160 is referred to a flexible wire, for example. Signal line 160 will be described later.

Loudspeaker 100 can include any voice coil other than voice coil body 120 without limitation. For example, a coil without a bobbin used in a microloudspeaker may also be used.

In the case of the present embodiment, voice coil body 120 includes damper 170. Damper 170 is a member having flexibility and resilience. The inner circumferential portion of damper 170 is attached to voice coil body 120, and the outer circumferential portion thereof is attached to top plate 113 of magnetic circuit 110. Damper 170 has a wavy shape where peaks are concentrically arranged. Damper 170 assists voice coil body 120 to linearly move forward and backward (in the Z-axis direction in the drawing). The configuration without a damper may be used to reduce the lowest resonance frequency of loudspeaker 100 and improve the sound quality. Damper 170 may be attached to diaphragm 130 rather than voice coil body 120.

Diaphragm 130 is a member to which voice coil body 120 is connected. Diaphragm 130 displaces forward and backward with respect to the neutral position (in the Z-axis direction in the drawing) based on the vibration of voice coil body 120 to displacement to vibrate air, thereby generating a sound. In the case of the present embodiment, diaphragm 130 has a cone shape having a diameter which decreases from the front side (positive side in the Z-axis in the drawing) to the back side. The outer circumferential portion of diaphragm 130 is attached to an end surface of the wall of housing 140 through edge 131 having more flexibility and resilience than those of diaphragm 130.

Diaphragm 130 can have any shape. Examples thereof include shapes of cones, ellipsis cones, and pyramids. Diaphragm 130 may also have a flat shape such as a circular plate, an elliptical plate, or a flat plate. Diaphragm 130 can be made of any material. Examples thereof include paper and resins.

Housing 140 is a box-shaped member which accommodates magnetic circuit 110, voice coil body 120, and damper 170. In the case of the present embodiment, housing 140 has a bottomed cylindrical shape, and is integrally formed with connector 142 projecting from the outer circumferential surface of wall 141 outwardly in the diameter direction. Wall 141 includes terminal base 143 attached thereto to project inwardly, that is, in the direction opposite to connector 142.

The outer circumferential portion of diaphragm 130 is attached to the lateral end surface of the opening end of housing 140 through edge 131 with an adhesive or the like. Magnetic circuit 110 is attached to the bottom surface of housing 140 with screw 144.

Housing 140 can be made of any material. In the case of the present embodiment, housing 140 is a resin molded article. The bottomed cylindrical body of housing 140, connector 142, and terminal base 143 are integrally molded with a resin. Furthermore, connection terminal 150 is also attached to housing 140 by insert molding during molding of housing 140.

Connector 142 connects loudspeaker 100 to an amplifier or the like. In the case of the present embodiment, connector 142 can be electrically connected to connection terminal 150 projecting inside connector 142, when the male connector disposed at the distal end of the output cable of the amplifier is inserted into connector 142. Thereby, the voice signal output from the amplifier can be input to voice coil body 120.

Figure 3:
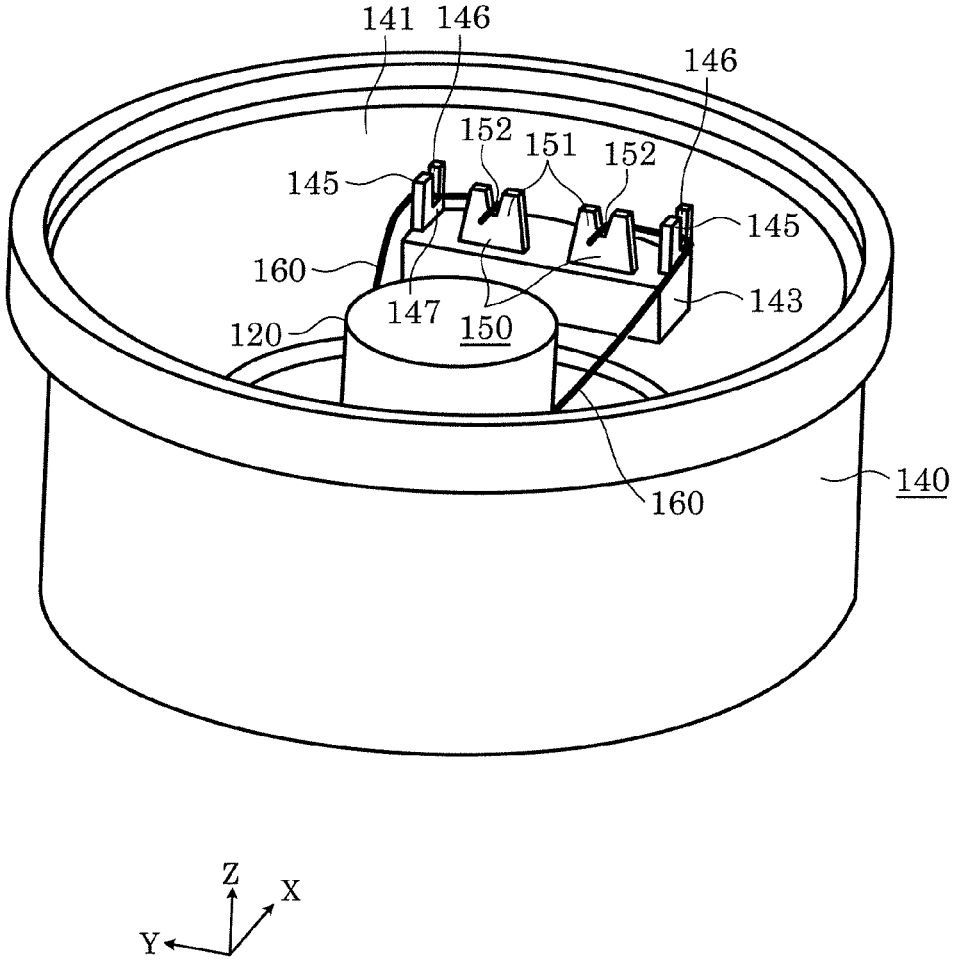
FIG. 3 is a perspective view illustrating the terminal base and its surrounding according to Embodiment 1, where the diaphragm, the damper, and the like are omitted.

FIG. 3 is a perspective view illustrating the terminal base and its surrounding according to Embodiment 1, where the diaphragm, the damper, and the like are omitted. As illustrated in FIG. 3, terminal base 143 is part of housing 140 which holds connection terminal 150 exposed at a predetermined position inside housing 140. Terminal base 143 is cantilevered, that is, projects from the inner circumferential surface of wall 141 of housing 140 toward voice coil body 120. The end of connection terminal 150 is exposed and projects from the top surface of the tip of terminal base 143 toward the opening end of housing 140. Terminal base 143 is disposed between top plate 113 of magnetic circuit 110 and diaphragm 130. Terminal base 143 further includes guide portions 145.

Guide portion 145 defines the wiring position of signal wire 160 during wiring of signal wire 160 in a space inside housing 140. In the case of the present embodiment, two guide portions 145 are aligned in a direction (in the X-axis direction in the drawing) orthogonal to the projecting direction of terminal base 143 within a plane parallel to a plane including the opening end of housing 140 (in the X-Y plane in the drawing), and are disposed outside connection portions 152 to signal wires 160 in two connection terminals 150, respectively, the two connection terminals being aligned in the same direction. Guide portion 145 includes slit 146 which can hold signal wire 160 in the state where signal wire 160 is supported. Guide portion 145 includes regulation portion 147 to dispose the distal end of signal wire 160 to be guided at a predetermined position closer to diaphragm 130 than proximal end 121 of signal wire 160 is.

Connection terminal 150 introduces a signal, which is output from the amplifier connected outside housing 140, into housing 140. Connection terminal 150 is configured with a conductor which is disposed such that one end thereof is exposed inside housing 140 and the other end is exposed outside housing 140. In the case of the present embodiment, connection terminal 150 has an L-shape. Connection terminal 150 projecting from the outer circumferential surface of wall 141 of housing 140 is electrically connected to a plug, which is to be inserted into connector 142. Attachment 151 is an end of connection terminal 150 exposed inside housing 140, and the distal end of signal wire 160 is connected to attachment 151. Attachment 151 includes a V-shaped slit for sandwiching the distal end of signal wire 160 which extends in the projecting direction of terminal base 143.

Two signal wires 160 are the ends of the wire material which forms a coil of voice coil body 120. Two signal wires 160 extend from voice coil body 120 and the distal ends thereof are connected to connection terminals 150, respectively. Each signal wire 160 is disposed in an inner space of housing 140 such that signal wire 160 is outwardly curved to be away from the virtual straight line (represented by the long dashed double-short dashed line in FIG. 2) connecting proximal end 121 of signal wire 160 closer to voice coil body 120 and connection portion 152 to connection terminal 150 and the distal end of signal wire 160 projects from connection portion 152 to connection terminal 150 toward voice coil body 120.

In the wiring state of signal wire 160 in the case of the present embodiment, each signal wire 160 is disposed so as to be gradually closer to the opening end surface of housing 140 in a region from proximal end 121 of signal wire 160 toward guide portion 145 of terminal base 143. Each signal wire 160 is also disposed to be held by slit 146 in a region from the outside toward the inside of guide portion 145. Each signal wire 160 is also disposed between attachment 151 and wall 141 of housing 140 in a region from guide portion 145 to attachment 151. Each signal wire 160 is also attached to attachment 151 so as to project from the side of wall 141 toward voice coil body 120. The distal end of signal wire 160 is fixed to attachment 151 of connection terminal 150 with solder to form electrical connection therebetween. As described above, two signal wires 160 are disposed in the space so as to be curved away from the virtual line by the positional relation between attachment 151 of connection terminal 150 and guide portion 145 in terminal base 143, the order of wiring, and the direction of wiring. Each signal wire 160 is disposed to pass a roundabout way through the side closer to wall 141 than connection portion 152.

According to loudspeaker 100 according to Embodiment 1, even in the case where housing 140 has a narrow inner space, effective wiring from voice coil body 120 to connection terminal 150 can be provided in an appropriate form. Accordingly, during driving of loudspeaker 100, signal wire 160 does not inhibit the reciprocal movement of voice coil body 120, and can prevent the interference of diaphragm 130 from signal wire 160, thereby implementing loudspeaker 100 having high acoustic properties.

The distal end of signal wire 160 is disposed to project with a predetermined distance from the side of wall 141 of housing 140 toward voice coil body 120. Such a configuration eliminates the operation to cut off the distal end of signal wire 160 which does not contribute to the connection to connection terminal 150, that is, the excess signal wire, resulting in an improved efficiency in assembling loudspeaker 100.

Embodiment 2

The loudspeaker according to Embodiment 2 includes a magnetic circuit including a magnetic gap; a voice coil body disposed in the magnetic gap in an inserted state; a diaphragm having an inner circumferential portion attached to the voice coil body; a damper having an inner circumferential portion attached to the voice coil body at a position closer to the magnetic circuit than the diaphragm; a damper base to which an outer circumferential portion of the damper is attached and which is attached to the magnetic circuit; a housing which accommodates the magnetic circuit, the voice coil body, the damper, and the damper base and to which the outer circumferential portion of the diaphragm and the magnetic circuit are attached; a terminal holder projecting from the damper base toward the diaphragm; two connection terminals which each have one end attached to the terminal holder and are disposed in the state where the two connection terminals penetrate through the wall of the housing; and two signal wires which each extend from the voice coil body and are connected to the connection terminals.

According to this, the signal wire can preliminarily be formed into an appropriate shape, and the magnetic circuit, the voice coil body, the damper, and the damper base can be assembled outside the housing. Accordingly, a signal wire having an appropriate shape can be readily implemented even in a housing having a relatively small inner space. In addition, undesirable influences on acoustic properties caused by interference of the signal wire from the diaphragm, the damper, and the like during driving of the loudspeaker can also be avoided.

Hereinafter, the loudspeaker according to Embodiment 2 will be specifically described with reference to the drawings. Identical reference numerals are given to components (parts) having actions, functions, shapes, mechanisms, and structures identical to those of Embodiment 1, and the descriptions thereof may be omitted in some cases. Hereinafter, the differences from Embodiment 1 will be mainly described, and the descriptions of the same contents will be omitted in some cases.

Figure 4:
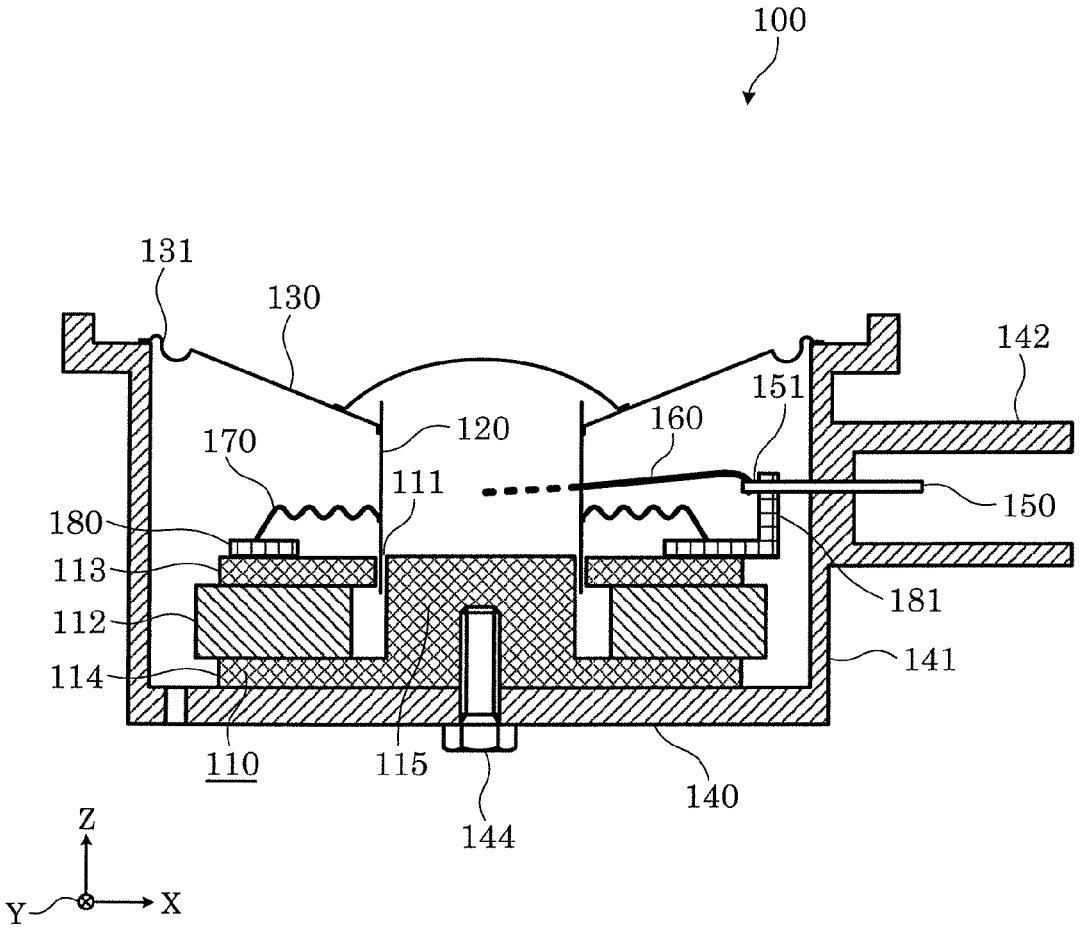
FIG. 4 is a sectional view illustrating the loudspeaker according to Embodiment 2.

FIG. 4 is a sectional view illustrating the loudspeaker according to Embodiment 2. FIG. 4 illustrates a cross-section corresponding to that of FIG. 1.

As illustrated in the drawing, as in Embodiment 1, loudspeaker 100 includes magnetic circuit 110, voice coil body 120, diaphragm 130, housing 140, connection terminal 150, signal wire 160, and damper 170. Loudspeaker 100 according to Embodiment 2 further includes damper base 180.

In the case of the present embodiment, connection terminal 150 has a linear shape without a bend, and attachment 151 is exposed inside housing 140.

The outer circumferential portion of damper 170 is attached to damper base 180 while the inner circumferential portion of damper 170 is attached to voice coil body 120. Damper base 180 is attached to magnetic circuit 110. In the case of the present embodiment, damper base 180 is an annular member made of a disk having a circular through hole in the center thereof. One surface of damper base 180 is attached to top plate 113 of magnetic circuit 110 with an adhesive, for example, and the outer circumferential portion of damper 170 is attached to the other surface thereof with an adhesive, for example. Damper base 180 also includes terminal holder 181 attached thereto to project from damper base 180 toward diaphragm 130. Damper base 180 can be made of any material. In the case where damper base 180 includes terminal holder 181 integrally formed therewith, damper base 180 is made of an insulating resin.

In the case of the present embodiment, terminal holder 181 is an L-shaped portion of damper base 180 projecting from the outer circumferential edge of damper base 180 toward wall 141 of housing 140 and then projecting toward diaphragm 130. Connection terminal 150 is attached to an end of terminal holder 181 close to diaphragm 130. Signal line 160 extending from voice coil body 120 is connected to connection terminal 150.

In loudspeaker 100 according to according to Embodiment 2, the operation to attach damper base 180 to magnetic circuit 110 and the operation to attach damper 170 to voice coil body 120 and damper base 180 can be performed outside housing 140. Furthermore, the operation to connect the distal end of signal wire 160 extending from voice coil body 120 to connection terminal 150 attached to terminal holder 181 can also be performed outside housing 140. Accordingly, wiring of signal wire 160 in an appropriate form can be readily performed without obstruction by housing 140.

After the wiring of signal wire 160 is completed, magnetic circuit 110 and the like are accommodated and fixed in housing 140, diaphragm 130 to assemble loudspeaker 100. Loudspeaker 100 thus obtained can have high acoustic properties because there is no interference between signal wire 160 and diaphragm 130 and between signal wire 160 and damper 170 even during driving of loudspeaker 100.

Embodiment 3

The loudspeaker according to Embodiment 3 includes a magnetic circuit including a magnetic gap; a voice coil body disposed in the magnetic gap in an inserted state; a diaphragm having an inner circumferential portion attached to the voice coil body; a housing which accommodates the magnetic circuit and the voice coil body and to which the outer circumferential portion of the diaphragm and the magnetic circuit are attached; two connection terminals which each have one end exposed inside the housing and another end exposed outside the housing and which are attached to the wall of the housing so as to extend over the wall; a holding member which holds the two connection terminals such that the connection terminals and the outer circumferential portion of the diaphragm are sandwiched between the holding member and the end surface of the wall; and two signal wires which extend from the voice coil body and are connected to the connection terminals.

According to this, insert molding of the housing and the connection terminals is not needed. After the signal wires are preliminarily connected to the connection terminals outside the housing, the connection terminals can be fixed to the housing using the holding member. Accordingly, even in a housing having a relatively small inner space, a signal wire having an appropriate shape can be readily implemented. In addition, undesirable influences on acoustic properties caused by interference of the signal wire from the diaphragm, the damper, and the like during driving of the loudspeaker can also be avoided.

Hereinafter, the loudspeaker according to Embodiment 3 will be specifically described with reference to the drawings. Identical reference numerals are given to components (parts) having actions, functions, shapes, mechanisms, and structures identical to those of Embodiments 1 and, and the descriptions thereof may be omitted in some cases. Hereinafter, the differences from Embodiments 1 and 2 will be mainly described, and the descriptions of the same contents will be omitted in some cases.

Figure 5:
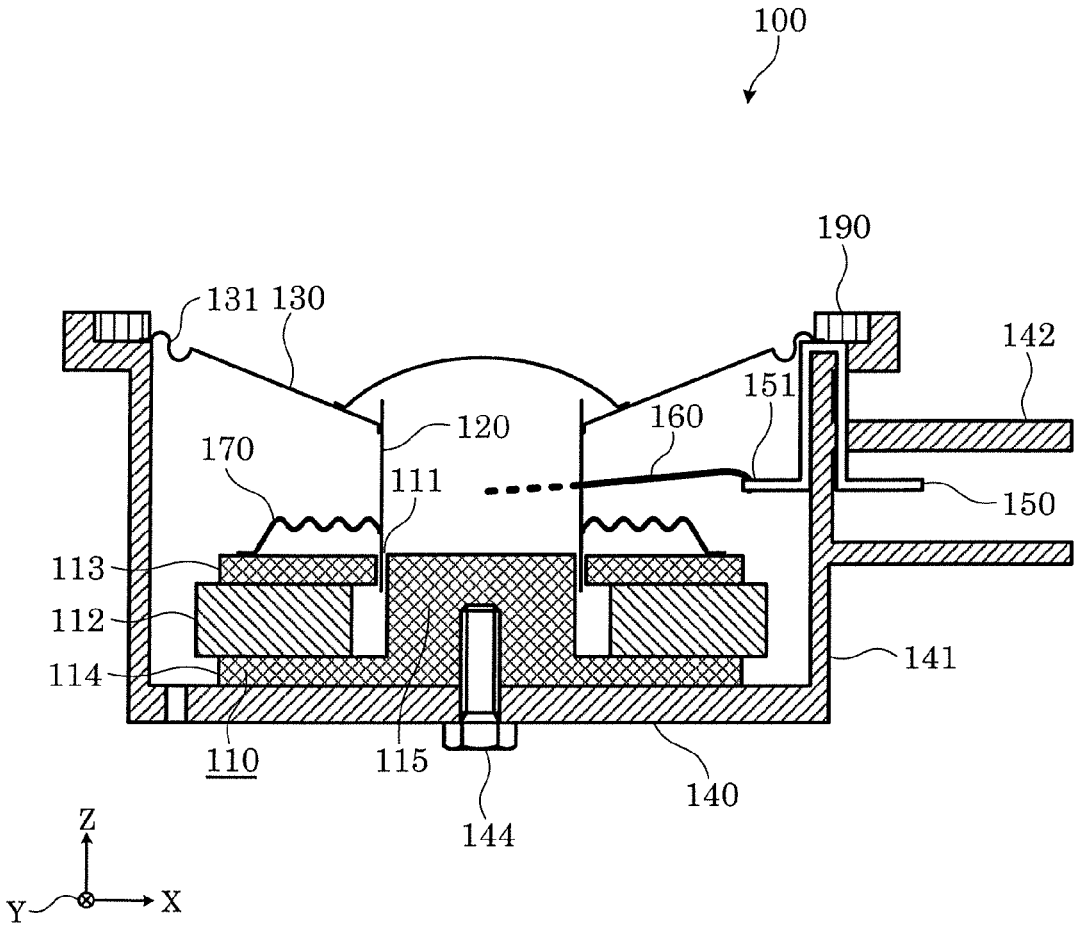
FIG. 5 is a sectional view illustrating the loudspeaker according to Embodiment 3.

FIG. 5 is a sectional view illustrating the loudspeaker according to Embodiment 3. FIG. 5 is a cross-section corresponding to that of FIG. 1.

As illustrated in the drawing, as in Embodiment 1, loudspeaker 100 includes magnetic circuit 110, voice coil body 120, diaphragm 130, housing 140, connection terminal 150, signal wire 160, and damper 170. Loudspeaker 100 according to Embodiment 2 further includes holding member 190.

In the case of the present embodiment, connection terminal 150 has one end exposed inside housing 140 and the other end exposed outside housing 140 and inside connector 142, and is bent into a crank shape so as to extend over the end of wall 141 of housing 140. Two connection terminals 150 have the same shape, and are disposed parallel to wall 141 of housing 140.

Holding member 190 is a member which holds two connection terminals 150, which are attached so as to extend over wall 141 of housing 140, such that the two connection terminals and edge 131 located at the outer circumferential portion of diaphragm 130 are sandwiched between holding member 190 and the end surface of wall 141. In the case of the present embodiment, holding member 190 has an annular shape matching with the opening end of housing 140 having a cylindrical shape. Holding member 190 can be made of any material. Examples thereof include resins, paper impregnated with a resin, and metals. Holding member 190 is attached to the opening end of housing 140 with an adhesive or the like. The rigidity of housing 140 and holding member 190 results in secure fixation of connection terminal 150 to housing 140.

According to loudspeaker 100 according to Embodiment 3, attachment of the connection terminal to housing 140 by insert molding is not needed, and thus housing 140 can be readily manufactured. Alternatively, after connection terminal 150 is attached to housing 140 using holding member 190, signal wire 160 and connection terminal 150 can be connected; or after the distal end of signal wire 160 is connected to connection terminal 150 having a crank shape outside housing 140, connection terminal 150 can be attached to housing 140 using holding member 190.

Because connection terminal 150 bent into a crank shape is fixed so as to extend over wall 141 of housing 140, unlike connection terminal 150 insert molded, drop off of connection terminal 150 from housing 140 can be prevented when the male connector is put into or pulled out of connector 142.

Embodiment 4

Figure 6:
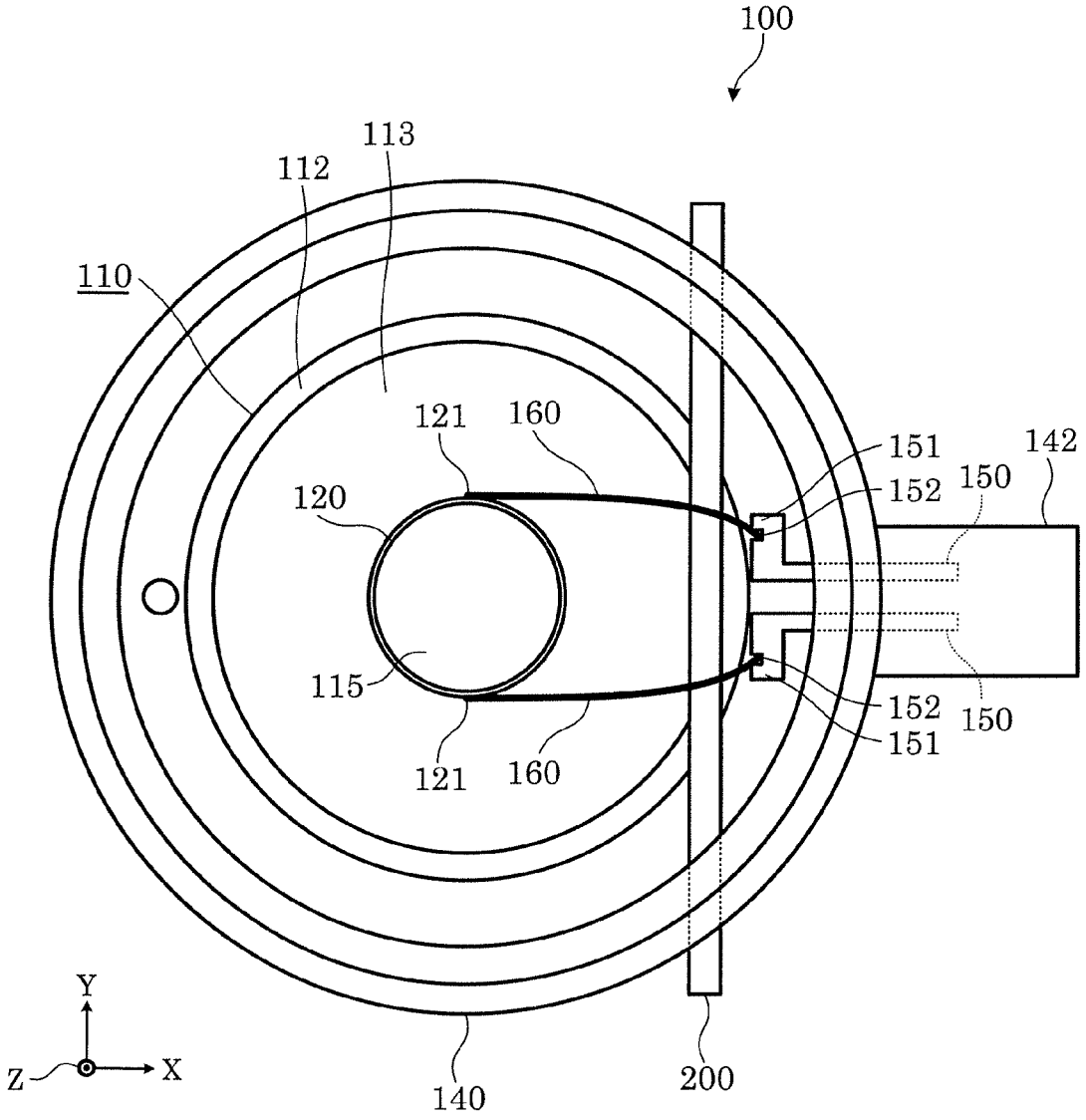
FIG. 6 is a plan view illustrating the loudspeaker in the state where a wiring jig is inserted into the housing, where the diaphragm, the damper, and the like are omitted.
Figure 7:
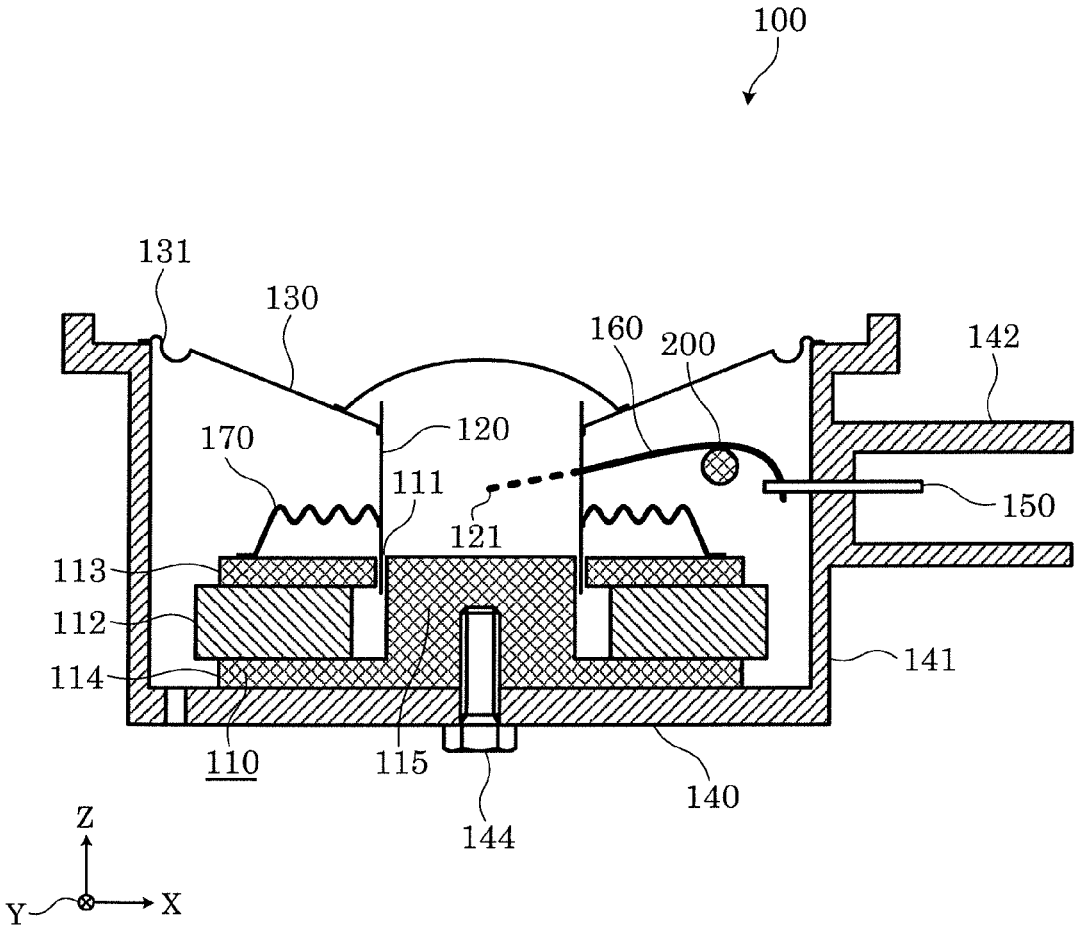
FIG. 7 is a sectional view illustrating the loudspeaker in the state where the wiring jig is inserted into the housing.

The method of manufacturing loudspeaker 100 will now be described as Embodiment 4. FIG. 6 is a plan view illustrating a loudspeaker in the state where a wiring jig is inserted into the housing, where the diaphragm, the damper, and the like are omitted. FIG. 7 is a sectional view illustrating a loudspeaker through which a wiring jig is inserted.

Before wiring jig 200 is inserted into housing 140 illustrated in the drawings, components are assembled into a subassembly outside housing 140, and the resulting subassembly is attached to housing 140. Specifically, voice coil body 120 is inserted into magnetic gap 111 of magnetic circuit 110, and damper 170 is attached to magnetic circuit 110 and voice coil body 120. Magnetic circuit 110, voice coil body 120, damper 170 in the form of the resulting subassembly are accommodated in housing 140.

In the next step, in a region which extends between voice coil body 120 and connection terminal 150 and is closer to the opening of housing 140 than proximal end 121 of signal wire 160, wiring jig 200 is inserted into the through hole, which is disposed in wall 141 of housing 140, in a direction orthogonal to the axis line of voice coil body 120. Although wiring jig 200 is illustrated as a rod-shaped member in the case of the present embodiment, wiring jig 200 can have any shape. According to the wiring shape of signal wire 160, wiring jig 200 may have a cutout or protrusion portion to which signal wire 160 is hooked. Although wiring jig 200 illustrated is bridged between the through holes disposed at two places of wall 141 of housing 140, the through hole may be disposed only at one place of housing 140.

The position of wiring jig 200 is determined without deviation by disposing wiring jig 200 using the through hole(s) disposed in wall 141 of housing 140 as above. Accordingly, even in the case where a plurality of multiple loudspeakers 100 is manufactured, the position of wiring jig 200 is stabilized, and thus the shape of signal wire 160 using wiring jig 200 is also stabilized. As a result, fluctuation in acoustic properties between loudspeakers 100 can be reduced.

In the next step, using wiring jig 200 inserted through wall 141 of housing 140, signal wires 160 are formed into a curve shape so as to project toward the opening of housing 140. In other words, signal wires 160 are formed so as to be gradually closer to the opening end of housing 140 in a region from proximal end 121 of signal wire 160 toward connection terminal 150 and then be gradually away from the opening end.

In the next step, two connection terminals 150 having one end exposed inside housing 140 and the other end exposed outside housing 140 are connected to signal wires 160, respectively, inside housing 140. Any connection method can be used without limitation. In the case of the present embodiment, the distal end of signal wire 160 is placed into a slit disposed in connection terminal 150, and is connected thereto by soldering.

In the next step, wiring jig 200 is pulled out of housing 140, and the through holes disposed in wall 141 of housing 140 are closed with a closing member. The through holes can be closed using any closing member as long as it is a member which blocks the air circulation in the through holes, such as a putty to be buried into the through holes, a packing to be inserted into through hole, or a sheet to close the opening end surfaces of the through holes.

The present disclosure is not limited to the embodiments described above. For example, any combination of the components described in this specification may be implemented as an embodiment according to the present disclosure or other embodiments excluding some of the components may also be implemented as embodiments according to the present disclosure. Moreover, the present disclosure also covers modifications obtained through a variety of modifications of the above-mentioned embodiments conceived by persons skilled in the art without departing the gist of the present disclosure, that is, the scope of claims.

For example, although signal wire 160 is connected to connection terminal 150 in the state where wiring jig 200 is disposed inside housing 140, signal wire 160 may be connected to connection terminal 150 after wiring jig 200 is removed from housing 140.

Not only signal wire 160 may be connected to connection terminal 150 inside housing 140, but also connection terminal 150 may be attached to housing 140 after the connection of signal wire 160 to connection terminal 150.

Although loudspeaker 100 including damper 170 has been exemplified, loudspeaker 100 without damper 170 may be used.

Housing 140 may have not only a bottomed cylindrical shape but also any other shape such as a rectangular box shape.

While various embodiments have been described herein above, it is to be appreciated that various changes in form and detail may be made without departing from the spirit and scope of the present disclosure as presently or hereafter claimed.

Further Information about Technical Background to this Application

The disclosures of the following Japanese Patent Applications including specification, drawings and claims are incorporated herein by reference in their entirety: PCT International Application Number PCT/JP2018/037521 filed on Oct. 9, 2018 and Japanese Patent Application Number 2017-198553 filed on Oct. 12, 2017.

INDUSTRIAL APPLICABILITY

The present disclosure is useful for relatively compact loudspeakers having limitations on the shape and the wiring path of the signal wire extending from the voice coil.

What is claimed is:

1. A loudspeaker, comprising:

a magnetic circuit including a magnetic gap;

a voice coil body disposed in the magnetic gap in an inserted state;

a diaphragm having an inner circumferential portion attached to the voice coil body;

a housing which accommodates the magnetic circuit and the voice coil body and to which an outer circumferential portion of the diaphragm and the magnetic circuit are attached;

two connection terminals disposed in a state where one ends of the two connection terminals are exposed inside the housing and another ends of the two connection terminals are exposed outside the housing; and two signal wires each extending from the voice coil body and having a distal end connected to a corresponding one of the two connection terminals, wherein each of the two signal wires is outwardly curved to be away from a virtual straight line connecting a proximal end of a corresponding one of the two signal wires, which is closer to the voice coil body, and a connection portion of the corresponding one of the two signal wires to the corresponding one of the two connection terminals, each of the two signal wires is extending from the voice coil body in a same direction, is outwardly curved to be away from the virtual straight line in an opposite direction, and is connected to the connection portion in a state of being close to each other, and the distal end of the corresponding one of the two signal wires projects from the connection portion toward the voice coil body.

2. The loudspeaker according to claim 1, further comprising:

a damper having an inner circumferential portion attached to the voice coil body at a position closer to the magnetic circuit than the diaphragm;

a damper base to which an outer circumferential portion of the damper is attached and which is attached to the magnetic circuit; and a terminal holder projecting from the damper base toward the diaphragm, wherein the two connection terminals each have one end attached to the terminal holder, and are disposed in a state where the two connection terminals penetrate through a wall of the housing.

3. A method of manufacturing a loudspeaker, comprising:

accommodating a magnetic circuit and a voice coil body in a housing, the magnetic circuit including a magnetic gap and the voice coil body being disposed in the magnetic gap in an inserted state;

inserting a wiring jig into a through hole disposed in a wall of the housing in a direction orthogonal to an axis line of the voice coil body in a region which extends between the voice coil body and two connection terminals and is closer to an opening of the housing than proximal ends of two signal wires;

molding the two signal wires, which extend from the voice coil body, into a curve shape using the wiring jig so as to project toward the opening of the housing;

connecting the two signal wires to the two connection terminals each having one end exposed inside the housing and another end exposed outside the housing;

removing the wiring jig from the housing; and closing the through hole with a closing member.

4. A method of manufacturing a loudspeaker, comprising:

connecting distal ends of two signal wires extending from a voice coil body to proximal ends of two connection terminal, wherein each of the two signal wires is outwardly curved to be away from a virtual straight line connecting a proximal end of a corresponding one of the two signal wires, which is closer to the voice coil body, and a connection portion of the corresponding one of the two signal wires to the corresponding one of the two connection terminals, each of the two signal wires is extending from the voice coil body in a same direction, is outwardly curved to be away from the virtual straight line in an opposite direction, and is connected to the connection portion in a state of being close to each other, and a distal end of the corresponding one of the two signal wires projects from the connection portion toward the voice coil body;

accommodating a magnetic circuit and the voice coil body in a housing, the magnetic circuit including a magnetic gap and the voice coil body being disposed in the magnetic gap in an inserted state;

attaching the two connection terminals to the housing, after the connection of the two signal wires to the two connection terminals, such that distal ends of the two connection terminals project to an outside of the housing;

attaching an inner circumferential portion of a diaphragm to the voice coil body; and attaching an outer circumferential portion of the diaphragm to the housing.

* * * * *